US007526932B2

(12) United States Patent
Füntmann

(10) Patent No.: US 7,526,932 B2
(45) Date of Patent: May 5, 2009

(54) CABLE LOCK

(76) Inventor: Jörg Füntmann, Ahmser Strasse 103, Herford (DE) D-32052

( * ) Notice: Subject to any disclaimer, the term of this patent is extended or adjusted under 35 U.S.C. 154(b) by 0 days.

(21) Appl. No.: 11/732,432

(22) Filed: Apr. 3, 2007

(65) Prior Publication Data

US 2007/0232153 A1 Oct. 4, 2007

(30) Foreign Application Priority Data

Apr. 3, 2006 (DE) ..... 10 2006 015 833

(51) Int. Cl.
*E05B 69/00* (2006.01)

(52) U.S. Cl. ..... 70/58; 70/14; 70/18; 70/30; 70/49

(58) Field of Classification Search ..... 70/14, 70/18, 19, 30, 49, 52, 53, 58
See application file for complete search history.

(56) References Cited

U.S. PATENT DOCUMENTS

| | | | | | |
|---|---|---|---|---|---|
| 351,063 | A | * | 10/1886 | McCormick | 70/65 |
| 539,650 | A | * | 5/1895 | Searle | 70/16 |
| 1,461,725 | A | * | 7/1923 | Cooper | 70/18 |
| 1,475,256 | A | * | 11/1923 | Belair | 70/18 |
| 1,512,589 | A | * | 10/1924 | Freysinger | 70/39 |
| 1,530,177 | A | * | 3/1925 | Heyer | 70/39 |
| 1,660,040 | A | * | 2/1928 | Lehtonen | 24/134 KB |
| 2,190,661 | A | * | 2/1940 | Hauer | 70/49 |
| 3,897,161 | A | * | 7/1975 | Reinwall, Jr. | 403/211 |
| 4,881,387 | A | * | 11/1989 | Kortenbrede | 70/39 |
| 5,398,529 | A | * | 3/1995 | Goldman et al. | 70/38 A |
| 5,473,917 | A | * | 12/1995 | Say | 70/49 |
| 5,517,835 | A | * | 5/1996 | Smith | 70/14 |
| 5,640,861 | A | * | 6/1997 | Chen | 70/38 A |
| 5,743,117 | A | * | 4/1998 | Woo et al. | 70/16 |
| 5,791,170 | A | * | 8/1998 | Officer | 70/49 |
| 6,526,785 | B1 | | 3/2003 | Asenstorfer et al. | |
| 6,609,399 | B1 | * | 8/2003 | Daniels, Jr. | 70/49 |
| 6,629,440 | B1 | * | 10/2003 | Meekma et al. | 70/49 |
| 7,007,518 | B1 | * | 3/2006 | Taper | 70/16 |
| 7,152,439 | B1 | * | 12/2006 | Chang | 70/30 |

FOREIGN PATENT DOCUMENTS

EP 1 058 765 B1 3/2003

* cited by examiner

*Primary Examiner*—Suzanne D Barrett
(74) *Attorney, Agent, or Firm*—Laurence A. Greenberg; Werner H. Stemer; Ralph E. Locher

(57) ABSTRACT

A cable lock which is simple, functionally reliable and can be produced economically, includes a housing with a through-passage for a cable and a clamping element deflected laterally in a locking position from a cable being inserted there and blocked against giving way. An adjusting member neutralizes the blocking of the clamping element in an open position, achieved by mounting the clamping element, on its side remote from the cable, with play in an elongated-hole-like aperture. A sliding element is inserted behind the clamping element in a guide running transversely to the aperture. The sliding element is linked to the adjusting member through a connecting piece. The sliding element is located behind the clamping element in an initial and locking position and is displaced laterally by the rotated adjusting member and the connecting piece in an open position and the play in the aperture is released.

6 Claims, 3 Drawing Sheets

CABLE LOCK

CROSS-REFERENCE TO RELATED APPLICATION

This application claims the priority, under 35 U.S.C. § 119, of German Patent Application DE 10 2006 015 833.4-41, filed Apr. 3, 2006; the prior application is herewith incorporated by reference in its entirety.

BACKGROUND OF THE INVENTION

Field of the Invention

The invention relates to a cable lock including a housing with a through-passage for a cable and a locking device for the cable. A clamping element extends in an initial position laterally at right angles thereto into the through-passage, is deflected laterally in a locking position from a cable inserted there and is blocked mechanically against giving way, in such a way that the cable is locked in a force-locking and friction-locking manner against being pulled out counter to its insertion direction. An adjusting member mounted in the housing is rotatable by a key inserted into a lock and neutralizes the blocking of the clamping element in an open position.

A force-locking connection is one which connects two elements together by force external to the elements, as opposed to a form-locking connection which is provided by the shapes of the elements themselves.

Such a cable lock which is provided as an anti-theft device for skis in European Patent EP 1 058 765 B1, corresponding to U.S. Pat. No. 6,526,785, has a locking device including, in addition to the clamping element, further components such as a central adjusting member, a pivoted lever and coupling elements which are each mechanically coupled to one another and are rotatable about axes or are guided in guides. That entails a disadvantage which is that the complicated construction is unfavorable economically and the functioning of those complex components can scarcely be ensured for a prolonged period in rough everyday use.

SUMMARY OF THE INVENTION

It is accordingly an object of the invention to provide a cable lock, which overcomes the hereinafore-mentioned disadvantages of the heretofore-known devices of this general type and which is simple, functionally reliable and can be produced economically.

With the foregoing and other objects in view there is provided, in accordance with the invention, a cable lock, comprising a housing having a through-passage for a cable and a locking device for the cable. A clamping element extends in an initial position laterally at right angles to and into the through-passage and is deflected laterally in a locking position from the cable inserted in the through-passage and blocked mechanically against giving way, for locking the cable in a force-locking and friction-locking manner against being pulled out against an insertion direction of the cable. The clamping element has a side remote from the cable being mounted with play in an elongated-hole-shaped aperture extended in direction of the through-passage. An adjusting member is mounted in the housing. A lock receives a key to permit rotation of the adjusting member for neutralizing the blocking of the clamping element in an open position. A guide extends transversely to the aperture. A sliding element is inserted behind the clamping element in the guide. A connecting piece links the sliding element to the adjusting member. The sliding element is located behind the clamping element in the initial and locking position for blocking the play in the aperture. The sliding element is displaced laterally by the rotated adjusting member and the connecting piece in the open position for releasing the play in the aperture.

In this cable lock, the locking device accordingly is formed of only a few components of simple construction. The adjusting member and the sliding element are connected to one another in an articulated manner through a connecting-rod-like connecting piece, in such a way that it is also not necessary for any pivots of operating levers to be provided in the housing, as is the case in the previously known prior art. The simple construction of the components ensures that a malfunction of the cable lock can be completely ruled out.

As in the known cable lock, it is also possible in this case to insert the cable into the through-passages from both sides, with the clamping element in each case being deflected laterally in the insertion direction and the cable, if it is attempted to pull it out in the opposite direction to the insertion direction, being pressed against the inner side, opposite the clamping element, of the through-passage and clamped in place. The clamping element is supported through its pivot directly on the side walls of the aperture in the housing and indirectly with its rear side laterally on the sliding element on the housing of the cable lock, in the course of which no force is exerted on the lock, which, through the connecting-rod-like connecting piece, holds the sliding element in its position blocking the movement of the clamping element. It is not until the adjusting member is rotated through the use of a key inserted into the lock that the sliding element is pushed forward under the clamping element in its guide running transversely to the aperture, in such a way that the clamping element can move inward into the housing in the elongated-hole-like aperture and release the inserted cable again as a result.

This structure is extremely simple, effective, very robust, requires only a few components of simple construction and prevents any possibility of a malfunction through the articulated connection of the adjusting member and the sliding element.

In accordance with another especially preferred feature of the invention, the connecting piece is linked eccentrically to the adjusting member like a connecting rod and is likewise linked to the sliding element in an articulated manner, in such a way that the latter can be displaced in a reciprocating manner in the guide disposed radially and parallel to the through-passage. Such a construction enables the pull-out forces exerted on a cable, if a theft is attempted, to be absorbed directly in the housing region of appropriately robust construction without an effect on the lock.

In accordance with a further feature of the invention, the side of the clamping element which is remote from the cable is provided with a pivot which is guided in an aperture of the housing. Therefore, a distribution of the reaction forces can be achieved since, for example, the transverse forces can be transmitted from the clamping element to the housing transversely to the aperture in its side wall and the longitudinal forces in the clamping element act at right angles on the side surface of the sliding element, which in turn transmits the transverse forces to the side walls of the guide and thus to the housing.

This absorption of force by different housing components additionally increases the safety of the cable lock, since the corresponding regions are constructed to be especially resistant to a deliberate application of force.

In accordance with an added feature of the invention, two identical locking devices are disposed centro-symmetrically relative to a center axis and two connecting pieces are disposed opposite one another on the adjusting member of the lock. This makes it possible to insert a cable into two through-passages from two opposite directions, in such a way that the cable lock, in the simplest manner, for instance after placing the cable around a bicycle frame and around a possibly fixed object such as a bicycle stand, can simply be put onto the two ends of the cable, which can also be done without a key in the lock. However, it is also conceivable to form two loops one after the other at a cable end fixed to the lock, for instance in order to put the cable first of all around the frame and the rear wheel and then around the frame and the front wheel, in order to thus obtain optimum theft protection.

In accordance with an additional feature of the invention, the housing of the cable lock has an integrated cable drum having a star-shaped lid rotatable relative to the housing. The cable can therefore be accommodated under the lid in a space-saving manner and a pulled-out cable can simply be rolled up again by a rotation of the housing.

In accordance with a concomitant feature of the invention, in order to prevent loss of the cable and also improve the handling, the cable end can be fixed in the housing. It is possible to unwind the cable by rotation of the lid against the winding direction of the cable and to pull the latter into the housing again by an opposite direction of rotation. To this end, the cable end is preferably provided with a nipple which is movably mounted in a receptacle in the housing.

Other features which are considered as characteristic for the invention are set forth in the appended claims.

Although the invention is illustrated and described herein as embodied in a cable lock, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
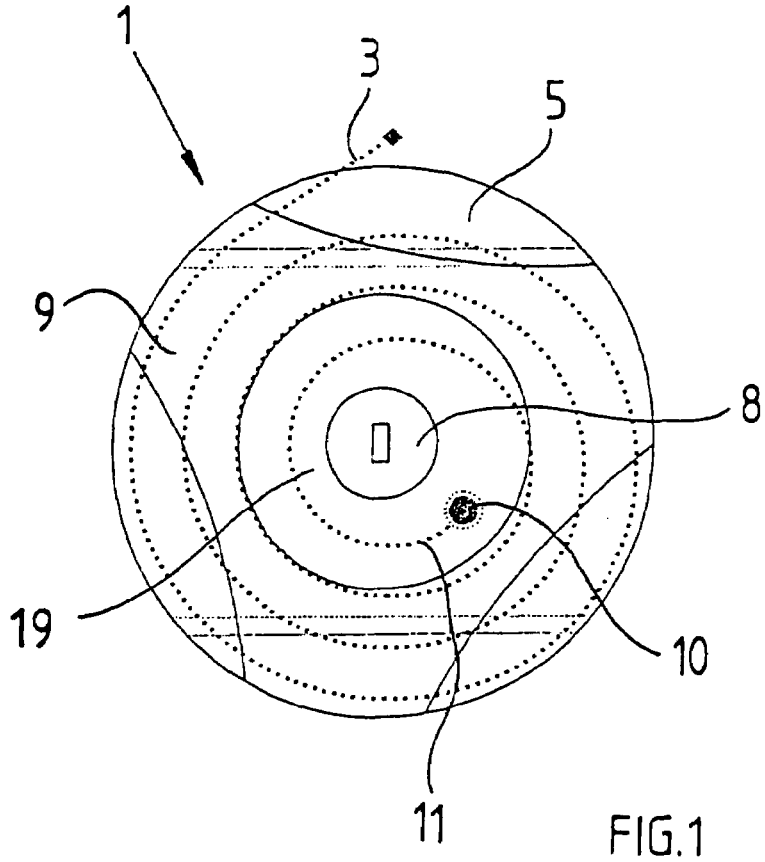
FIG. 1 is a diagrammatic, plan view of a cable lock.
Figure 2:
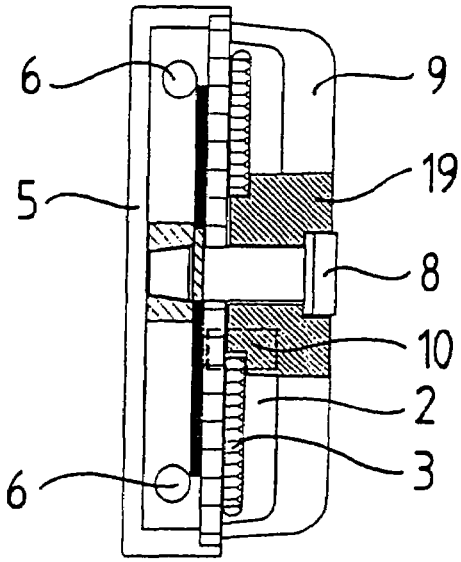
FIG. 2 is a sectional side view through the cable lock according to FIG. 1.

Referring now to the figures of the drawings in detail and first, particularly, to FIGS. 1 and 2 thereof, there is seen a cable lock 1 which is formed of a cylindrical housing 5 in which a locking device is disposed and which has a star-shaped lid 9, which is rotatably mounted on the housing 5 and below which a cable drum 2 is provided. A cable 3 is mounted on the cable drum 2 in a wound-up manner in an unused state of the cable lock 1. It is possible for the cable 3 to be brought forward out of the housing 5 by a rotation of the housing lid 9 against a winding direction of the cable 3.

A lock 8 is disposed in a center 19 of the lid 9 in such a way that, after insertion of a key, the locking device can be placed into or taken out of operation. An inner cable end 11 has a nipple 10, which is movably mounted in a corresponding receptacle in the housing 5 and the center 19 of the lid 9.

Figure 3:
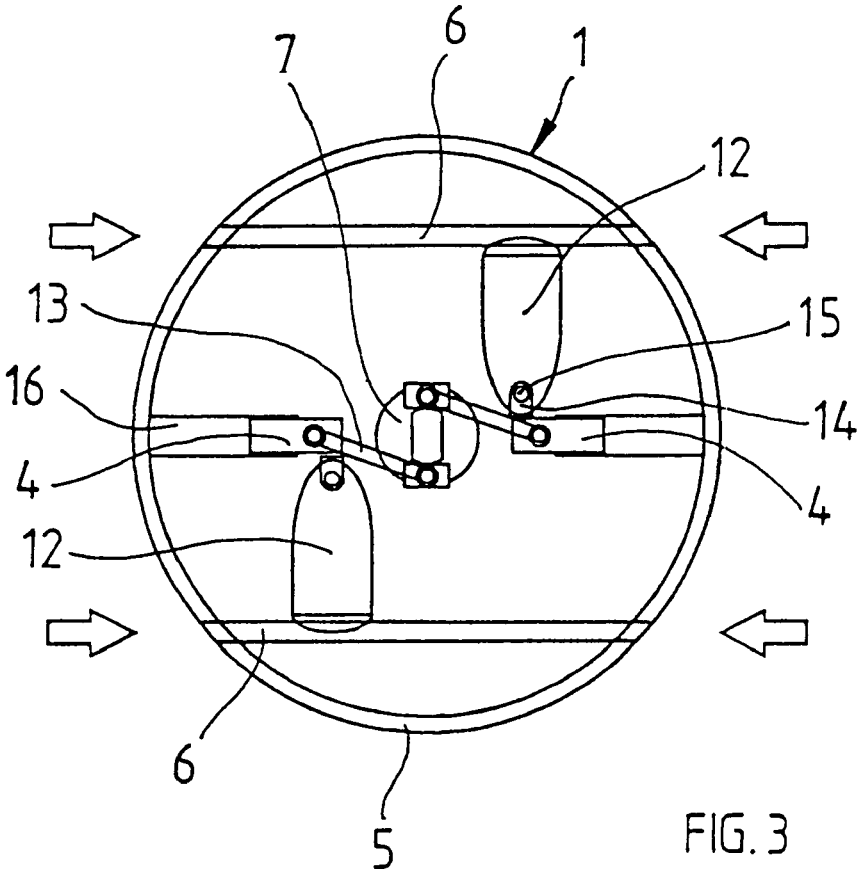
FIG. 3 is a sectional view through the cable lock in an initial position of a locking device.

The housing 5 has two through-passages 6 for the cable 3. As can be seen in FIG. 3, the locking device is formed of an adjusting member 7 which can be rotated by the key of the cable lock 1 and to which first ends of two connecting-rod-like connecting pieces 13 are linked in opposition through swivel hinges. Second ends of the connecting pieces 13 are disposed in an articulated manner on sliding elements 4 which are mounted in radial guides 16 that run parallel to the through-passages 6. Clamping elements 12, which extend in an initial position at right angles to the through-passages 6 and the guides 16, are mounted at sides thereof remote from the cables 3 in elongated-hole-like apertures 14 which extend in the direction of the through-passages 6. The sliding elements 4 are displaced behind the clamping elements 12 in an initial and locking position and block the play of the clamping elements 12 in the apertures 14. The blocking of the clamping elements 12 is neutralized in an open position with the adjusting member 7 rotated by 90° and the sliding elements 4 displaced outward.

In the initial position of the cable lock 1, the clamping elements 12 extend, as shown in FIG. 3, at right angles into the through-passages 6 of the housing 5. In this initial position, no cable 3 is inserted into the cable lock 1 and all elements are located in a basic position. However, the cable 3 can be inserted without the aid of a key through one of the four openings of the two through-passages 6 in any desired direction.

Figure 4:
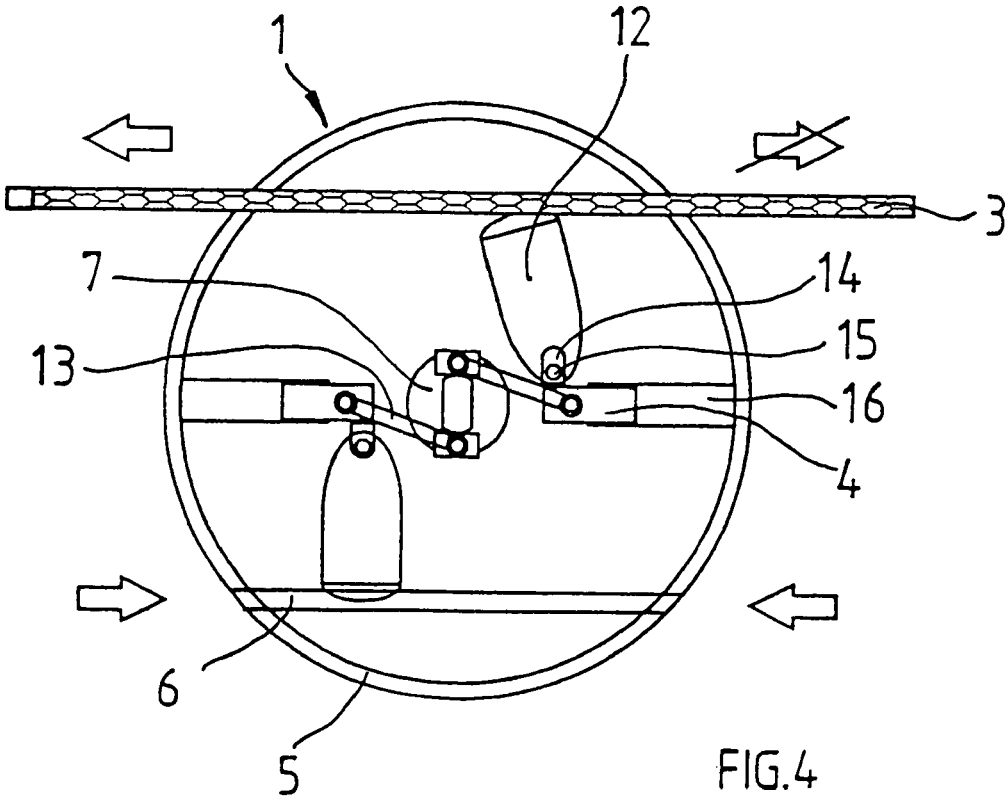
FIG. 4 is a view similar to FIG. 3 of the cable lock with a cable inserted from the right.

In the locking state, as shown in FIG. 4, a cable 3 is inserted from the right into the top through-passage 6. The clamping element 12 is deflected laterally, in a contact region with the cable 3, in a push-in direction of the cable 3 and, with its side opposite the cable 3 displaced laterally inward and resting on the sliding element 4 in the elongated-hole-like aperture 14 of the housing 5. Retraction of the cable 3 is prevented, since the sliding element 4 prevents the clamping element 12 from giving way toward the center. The clamping element 12 of the bottom locking device is still in the basic position.

Figure 5:
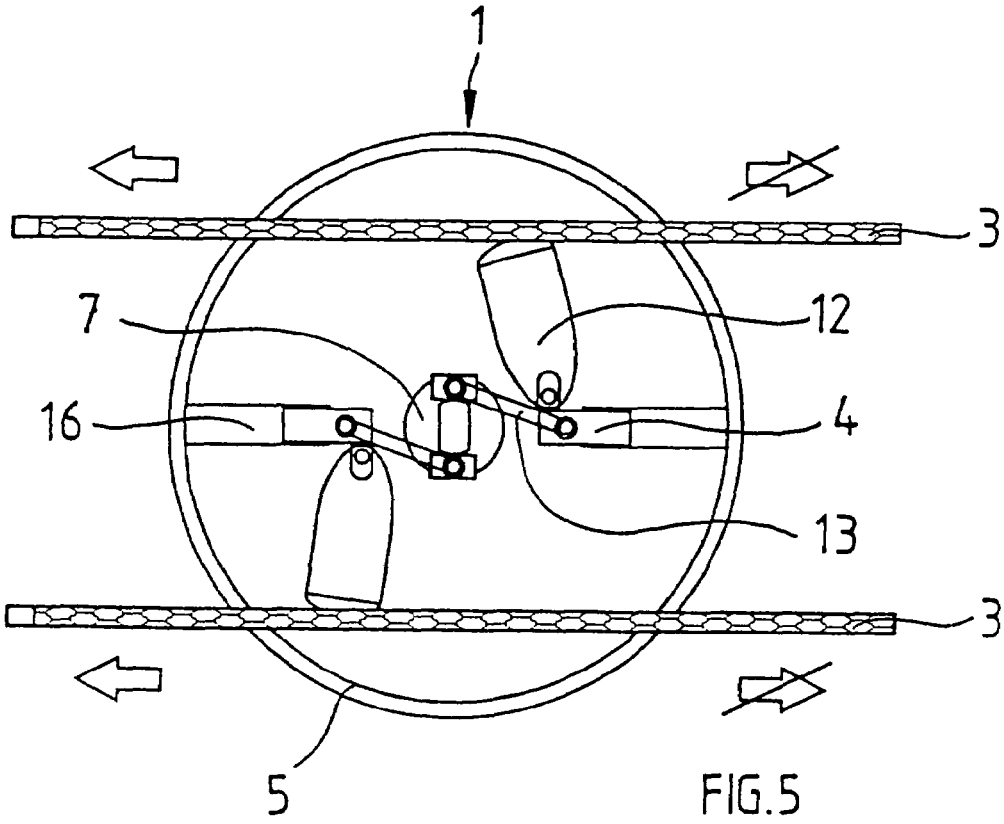
FIG. 5 is a view similar to FIG. 3 of the cable lock with two cables inserted from the right.

FIG. 5 shows a state in which the cable 3 is directed through both through-passages 6 and the two clamping elements 12 are each pivoted in the push-in direction. It is also not possible in this case to pull out the cable 3 against the push-in direction, a factor which is indicated by the crossed-out arrows.

Figure 6:
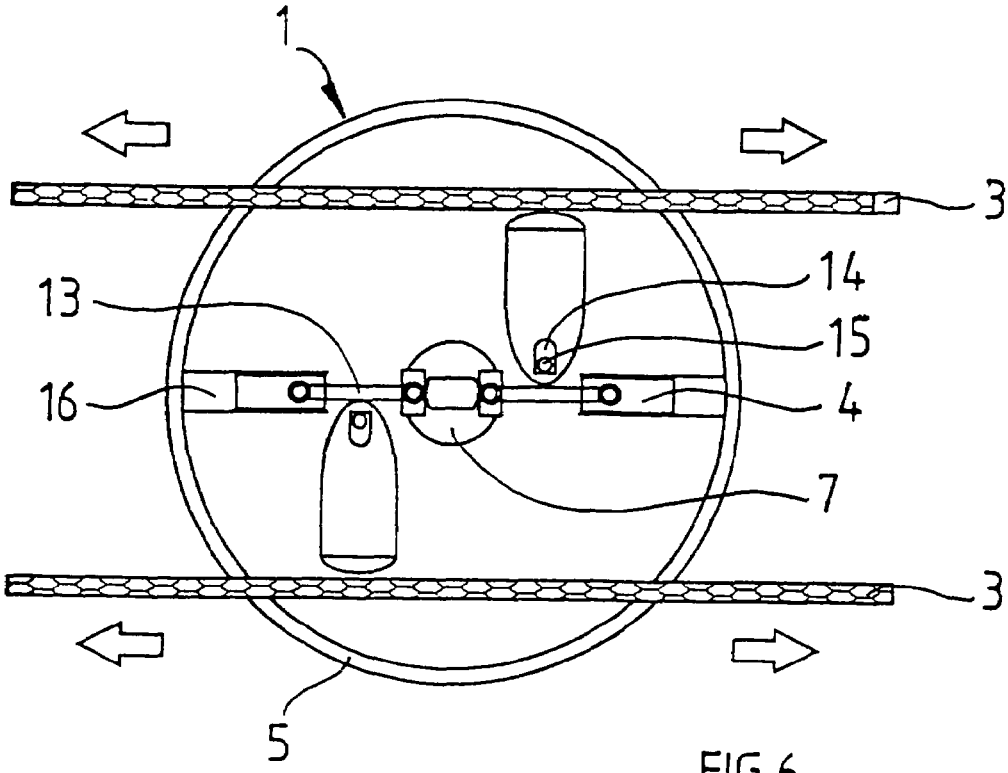
FIG. 6 is a view similar to FIG. 3 of the cable lock in an open position.

In the open position, as shown in FIG. 6, the adjusting member 7 is rotated by 90° after the cable lock 1 has been opened through the use of a key inserted into the lock 8. The connecting pieces 13 displace the sliding elements 4 radially outward in their guides 16, in such a way that the blocking of the movement of the clamping element 12 in the aperture 14 is neutralized and the clamping element 12 can escape inward into the housing 5 of the cable lock 1. As a result, the cable 3 can be released and can be pulled out through the through-passages 6 in any desired direction.

A force acting on the clamping element 12 against the push-in direction of the cable 3, if it is attempted to pull out the cable 3, is led in the pull-out direction through a pivot 15 of the clamping element 12 into side surfaces of the elongated-hole-like aperture 14 and results in immediate absorption of the force and is led from the rear side of the clamping element 12 to the side of the sliding element 4 and from the latter to the side surface of the guide 16 in the housing 5 and results in indirect transmission of force to the housing 5. In the process, the adjusting member 7 of the lock 8 remains substantially free of force.

I claim:

1. A cable lock, comprising:

a housing having a through-passage for a cable and a locking device for the cable;

a clamping element extended in an initial position laterally at right angles to and into said through-passage and being deflected laterally in a locking position from the cable inserted in said through-passage and blocked mechanically against giving way, for locking the cable in a force-locking and friction-locking manner against being pulled out against an insertion direction of the cable, said clamping element having a side remote from the cable being mounted with play in an elongated-hole-shaped aperture extended in direction of said through-passage;

an adjusting member mounted in said housing;

a lock for receiving a key to permit rotation of said adjusting member for neutralizing the blocking of said clamping element in an open position;

a linear radial guide extending transversely to said aperture, said radial guide being disposed parallel to said through-passage;

a sliding element inserted behind said clamping element in said guide and said sliding element being displaceably mounted in a reciprocating manner in said radial guide; and a connecting piece linking said sliding element to said adjusting member, said connecting piece being linked to said adjusting member in an articulated and eccentric manner and to said sliding element in an articulated manner, and said connecting piece for reciprocating said sliding element in said radial guide;

said sliding element being located behind said clamping element in said initial and locking position for blocking the play in said aperture, and said sliding element being displaced laterally by said rotated adjusting member and said connecting piece in said open position for releasing the play in said aperture.

2. The cable lock according to claim 1, wherein:

said side of said clamping element remote from the cable has a pivot projecting from said clamping element, guided in said aperture in said housing and transmitting clamping forces from said clamping piece to said housing transversely to said aperture; and said clamping element, in said locking position, bears laterally on said sliding element and transmits longitudinal forces to said housing transversely to said guide.

3. The cable lock according to claim 1, wherein said locking device is one of two identical locking devices disposed centro-symmetrically about a center axis, and said connecting piece is one of two connecting pieces disposed eccentrically opposite one another on said adjusting member.

4. The cable lock according to claim 1, which further comprises a cable drum disposed on said housing and having a star-shaped lid rotatable relative to said housing.

5. The cable lock according to claim 1, wherein the cable has a cable end fixed in said housing.

6. The cable lock according to claim 5, wherein said cable end has a nipple and is movably mounted in a receptacle in said housing.

* * * * *